US007172277B2

(12) United States Patent
Mizutani et al.

(10) Patent No.: US 7,172,277 B2
(45) **Date of Patent: *Feb. 6, 2007**

(54) TRANSFER PRESSURE ROLL, TRANSFER DEVICE AND IMAGE RECORDING APPARATUS

(75) Inventors: Hajime Mizutani, Nagano (JP); Hiroyuki Onishi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 127 days.

This patent is subject to a terminal disclaimer.

(21) Appl. No.: 10/763,402

(22) Filed: Jan. 22, 2004

(65) Prior Publication Data

US 2004/0218917 A1 Nov. 4, 2004

(30) Foreign Application Priority Data

Jan. 22, 2003 (JP) ..... P2003-014080

(51) Int. Cl.
*B41M 7/00* (2006.01)
*B41J 2/01* (2006.01)
*B41J 29/00* (2006.01)

(52) U.S. Cl. ..... 347/104; 347/105; 347/106; 347/101; 400/578; 400/679

(58) Field of Classification Search ..... None
See application file for complete search history.

(56) References Cited

U.S. PATENT DOCUMENTS 6,176,286 B1 * 1/2001 Kitagawa et al. ..... 156/555
6,471,810 B2 * 10/2002 Sawano ..... 156/230
2002/0005886 A1 * 1/2002 Iwata ..... 347/106
2002/0027313 A1 * 3/2002 Shibano et al. ..... 264/448

FOREIGN PATENT DOCUMENTS

| | | |
|---|---|---|
| JP | 60-23096 | 2/1985 |
| JP | 60 023096 | 2/1985 |
| JP | 60-189486 | 9/1985 |
| JP | 60 189486 | 9/1985 |
| JP | 61-230973 | 10/1986 |
| JP | 61 230973 | 10/1986 |
| JP | 07-276686 | 10/1995 |
| JP | 2001-10212 | 1/2001 |
| JP | 2001-270257 | 10/2001 |
| JP | 2001-341862 | 12/2001 |
| JP | 2002-113853 | 4/2002 |
| JP | 2002195248 A * | 7/2002 |

OTHER PUBLICATIONS

GELTEC website printout; Vocabulary; http://www.geltec.co.jp/english/vocabular/;2 pgs.*

(Continued)

*Primary Examiner*—Daniel J. Colilla
(74) *Attorney, Agent, or Firm*—Ladas and Parry LLP

(57) ABSTRACT

A transfer pressure roll is characterized in that a cylindrical roll body and an elastic layer which coats the surface of the roll body and comes into contact with an image protection film at the pressurizing time are included, and the hardness of an elastic matter forming the elastic layer is HA 40 degrees or more by a measuring method specified by JIS-K6253.

21 Claims, 4 Drawing Sheets

OTHER PUBLICATIONS

English Abstract of JP 60 023096 dated Feb. 5, 1985.
English Abstract of JP 60 189486 dated Sep. 26, 1985.
English Abstract of JP 60 230973 dated Oct. 15, 1986.
Patent Abstracts of Japan 07-276686 Dated Oct. 24, 1995.
Patent Abstracts of Japan 2001-270257 Dated Oct. 2, 2001.
Japanese Official Action dated Jun. 27, 2006 in Japanese Application No. 2003-335547 with English Translation.
Japanese Official Action dated Jun. 27, 2006 in Japanese Application No. 2003-014080 with English Translation.
Patent Abstract of JP 2001-10212.
Patent Abstract of JP 2002-113853.
Patent Abstract of JP 2001-341862.

* cited by examiner

PRIOR ART

TRANSFER PRESSURE ROLL, TRANSFER DEVICE AND IMAGE RECORDING APPARATUS

The present application is based on Japanese Patent Application No. 2003-14080, the entire contents of which are incorporated herein by reference.

BACKGROUND OF THE INVENTION

1. Field of the Invention

The present invention relates to a transfer pressure roll used when a protective layer for coating an image (particularly an ink jet image) formed on a recording medium by a recording system such as an ink jet recording system is provided, and a transfer device and an image recording apparatus which include the transfer pressure roll.

2. Related Art

The ink jet recording system is a printing system in which liquid droplets are ejected from minute nozzles of a recording head and attached onto a recording medium such as paper thereby to form an image. Recently, as a recording medium for ink jet recording, an ink jet recording coated paper has been developed, which is formed by providing, on a base material such as paper or a film, an ink-absorption layer including porous fine particles such as silica or aluminum as a main component. In result, an ink jet image of a high quality which is equal to a silver-halide photograph has been obtained. The surface of the ink-absorption layer, which is a recorded surfaced, is worked into a surface having surface quality suitable for use of the coated paper, for example, a specular surface, a luster surface, a matt surface, and a silky surface. Particularly, the luster surface of them is a finely rough surface having fine unevenness on its surface, so that it has a unique sense of semi-glossiness. The ink jet recording coated paper worked into the luster surface is suitable for output of a photo-like ink jet image that is like a silver halide photograph.

Though use of the above ink jet recording coated paper makes it possible to obtain an inkjet image sufficient for image quality, the ink jet image is inferior to the silver halide photograph in preservability such as light resistance, gas resistance, and wear resistance under the present conditions. The preservability of the ink jet image becomes more important as the ink jet recording technology is applied more widely to digital photograph service and commercial print. It is an important problem of the ink jet recording technology to supply the ink jet image that can be preserved for a long period.

As technology for heightening the preservability and glossy level of the ink jet image, an overcoat method has been known, in which a transparent film is stuck onto a surface of a recording material on which the ink jet image has been formed (ink jet image surface) thereby to form a protective layer which coats the ink jet image. As this overcoat method, there are a cold laminating method in which while a rear sheet (separator) of a film adhering at the normal temperature is peeled off, the film is being stuck onto the image surface; a heat (hot) laminating method in which while a thermoplastic resin film having no rear sheet is heated, it is being stuck onto the image surface; and a thermal transfer method in which an image protection film formed by providing a transparent film (transferable protection layer) on a supporting body is used, and the transparent film is thermal-transferred onto the image surface. Particularly, the thermal transfer method, compared with the other overcoat methods, makes formation of a thin protective layer possible. Therefore, the thermal transfer method has an advantage that excessively glossy level is not provided on the image surface, and its method is noticeable as an overcoat method which can heighten the preservability and the glossy level without losing the natural sense and quality level of the recording matter. Related arts on the thermal transfer method will be described for example, JP-A-60-23096 JP-A-60-189486, and JP-A-61-230973.

The thermal transfer method is executed by a transfer device. Usually, as shown in FIG. 7, a recording matter and an image protection film are superimposed on each other so that an ink jet image surface is opposed to the surface of a transferable protection layer, thereby to form a laminated sheet. This laminated sheet is permitted to pass through a nip portion formed between a heat roll and a pressure roll of the transfer device which are brought into pressure-contact with each other, whereby the laminated sheet is heated by the heat roll from the image protection film side, the transferable protection layer is melted and attached on the ink jet image surface by use of pressure, and thereafter the supporting body is peeled off from the laminated sheet. Hereby, a recording matter with a protective layer that fits the purpose is obtained.

In the above thermal transfer method, it is important to obtain sufficiently close attachment between the ink jet image surface and the transferable protection layer. This reason is that: in case that air bubbles mix between the image surface and the protective layer due to the bad close attachment, not only the recording matter is bad to look at but also color development of the image lowers and dignity of the recording matter remarkably lowers.

However, in case that the recording matter that is to form the protective layer uses the ink jet recording coated sheet having a luster-finished surface, that is, in case that the ink jet image surface is the luster-finished surface (finely rough surface), when the thermal transfer method is executed using the conventional transfer device as usual, the transferable protection layer does not sufficiently melt-enter the concave portions of the ink jet image surface, air bubbles mix in the concave portions, and the transferable protection layer is not attached closely onto the ink jet image surface (finely rough surface) by using press. Further, by the nip pressure between the heat roll and the pressure roll, the convex portions of the finely rough surface crash and become flat. In result, the protective layer surface of the recording matter with the protective layer becomes a flat specular surface with high glossiness level, so that a unique sense of the semi-glossy level the recording matter naturally has before forming of the protective layer is damaged.

SUMMARY OF THE INVENTION

It is an object of the invention to provide a transfer pressure roll which can attach closely the transferable protection layer by use of pressure onto an ink jet image formed on a finely rough surface having fine unevenness without causing mixing of air bubbles and flattening of the finely rough surface, can make the best use of the natural sense and quality level of the recording matter, and can provide a recording matter having high image-quality, high glossiness, and good preservability; and a transfer device and an image recording device which are provided with the transfer pressure roll.

A transfer pressure roll of the invention pressurizes a laminated sheet formed by laminating a recording matter in which an ink jet image is formed on a finely rough surface on which a large number of convex portions having the height of 5 to 20 μm are formed at 50 to 500 μm pitch, and an image protection film comprising a supporting body and a transferable protection layer provided on the supporting body so that the finely rough surface and the surface of the transferable protection layer are opposed to each other, from the image protection film side under heat, and uses pressure to attach the transferable protection layer onto the ink jet image. The roller is characterized in that a cylindrical roll body, and an elastic layer which coats the surface of the roll body and comes into contact with the image protection film at the pressurizing time are included, and the hardness of an elastic matter forming the elastic layer is HA 40 degrees or more by a measuring method specified by JIS-K6253.

Further, a transfer device of the invention includes a laminated sheet forming section which supplies, on an ink jet image of a recording matter in which the ink jet image is formed on a finely rough surface on which a large number of convex portions having 5 to 20 μm height are formed at 50 to 500 μm pitch, an image protection film comprising a supporting body and a transferable protection layer provided on the supporting body so that the finely rough surface and the surface of the transferable protection layer are opposed to each, and which superimpose the image protection film and the recording matter on each other thereby to form a laminated sheet of them; a press section which heat-pressurizes the laminated sheet thereby to attach the transferable protection layer on the ink jet image by using pressure; and a peeling-off section which peels off the supporting body from the laminated sheet which has passed through the press section. The transfer device is characterized in that: the above press section includes a pressure member and a pressure reception member; the above laminated sheet is permitted to pass through a nip portion formed between the pressure member and the pressure reception member which are brought into pressure contact with each other; and the pressure member is the above transfer pressure roll.

Further, an image recording apparatus of the invention includes an ink jet recording portion which ejects ink on a finely rough surface of a recording sheet having the finely rough surface on which a large number of convex portions having 5 to 20 μm height are formed at 50 to 500 μm pitch thereby to form an ink jet image, and a protection layer forming portion which thermal-transfers, onto the ink jet image, a transferable protection layer of an image protection film comprising a supporting body and the transferable protection layer provided on the supporting body thereby to form a protective layer. The image recording apparatus is characterized in that the above protection layer forming portion is composed of the above transfer device.

According to the transfer pressure roll of the invention, the hardness of the elastic matter that is a forming material of the elastic layer which comes into contact with the image protection film in the pressurizing time of the laminated sheet is HA 40 degrees or more by a measuring method specified by JIS-K6253. Therefore, in case that the laminated sheet is pressurized, the convex portions of the ink jet image surface that is the finely rough surface do not crash, and the heat-melted transferable protection layer corresponds to the uneven shape of the ink jet image surface and adopts itself to its shape very well. In result, the transfer pressure roll can closely attach the transferable protection layer onto the ink jet image surface by use of pressure. Further, by adjusting the thickness of the elastic layer in a range of 0.2 to 3 mm, it is possible to prevent mixing of the air bubbles and flattening of the finely rough surface more surely.

Further, according to the transfer device of the invention and the image recording apparatus including the transfer device, the above transfer pressure roll is adopted as the pressure member of the laminated sheet. Therefore, the recording matter with the protective layer which is superior in close attachment properties of the protective layer can be stably manufactured at comparatively low cost.

DETAILED DESCRIPTION OF THE PREFERRED EMBODIMENTS

The transfer pressure roll of the invention, together with the transfer device and the image recording apparatus which include the transfer pressure roll of the invention, will be described below in detail with reference to FIGS. 1 and 2.

Figure 1:
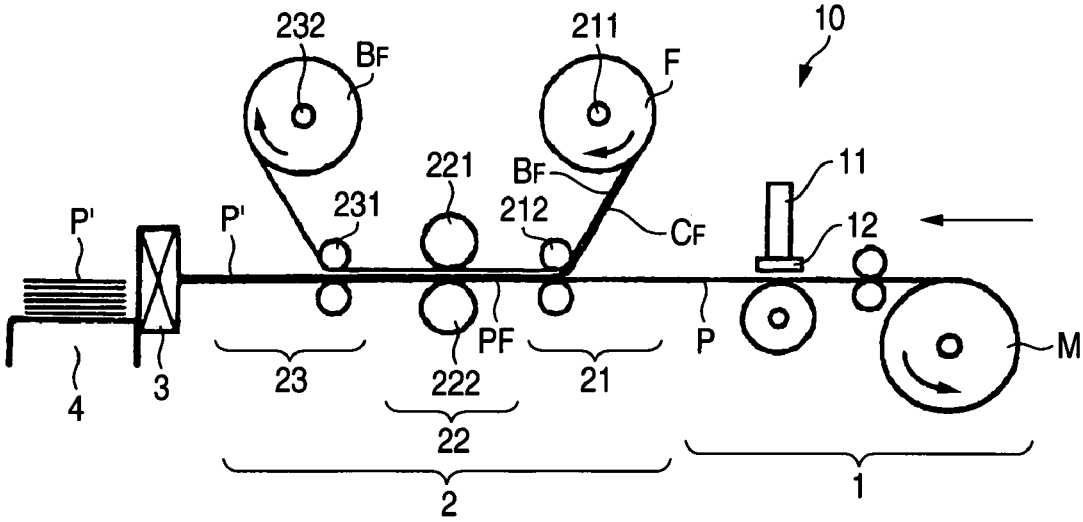
FIG. 1 is a schematically side view showing a main portion in one embodiment of an image recording apparatus of the invention.

FIG. 1 is a side view showing schematically a main portion of an image recording apparatus according to one embodiment of the invention. An image recording apparatus 10 shown in FIG. 1 includes an ink jet recording portion 1 which ejects ink on a recorded surface of a recording sheet M to form an ink jet image, and a protection layer forming portion 2 which transfers, on the recorded surface (ink jet image surface) on which the ink jet image has been formed, a transferable protection layer $C_F$ of an image protection film F comprising a supporting body $B_F$ and the transferable protection layer $C_F$ provided on the supporting body $B_F$ thereby to form a protective layer. Further, on the downstream side in the transporting feeding of the recording sheet M for the protection layer forming portion 2, an automatic cutter 3 which cuts a long sheet into a sheet of a unit length, and a sheet-discharge tray 4 which stocks the plural cut sheets cut into the sheets of the unit length are arranged. The protection layer forming portion 2 itself is a so-called film-transfer device. The image recording apparatus 10 is basically constituted so that the transfer device is incorporated into the ink jet recording apparatus corresponding to the roll sheet.

In the ink jet recording portion 1, the roll-type recording sheet M is fed out to a recording head (ink jet head) 11, and ink of each color is ejected on the recorded surfaced of the recording sheet M to form an ink jet image, whereby a recording matter P is made. Thereafter, the recording matter P is transported to the protection layer forming portion 2.

The recording head 11 is mounted on a carriage 12, and main-scanned by the carriage 12 in a direction orthogonal to the transporting direction of the recording sheet M. The recording head 11 may adopt a continuous type in which a head continues to eject ink at regular intervals and the ejected ink droplets are biased thereby to form an image, or an on-demand type in which a head ejects ink correspondingly to image data. Further, as an ink ejection method, there are a method of controlling the ink ejection by a voltage using a piezoelectric element, and a method of controlling the ink ejection by heat energy using a heat generation resistant element. The ink ejection method is not particularly limited. Further, the recording head 11 may adopt a cartridge type in which an ink tank is formed integrally with a head itself or a type in which ink is supplied through a tube from an ink tank provided separately from a recording head.

As ink used in the ink jet recording portion 1, any ink for ink jet recording maybe used. For example, any of water-dye ink and pigment ink can be used. Generally, the pigment ink is better in light resistance and water resistance of the recording image than the dye ink. Therefore, by forming the ink jet image using the pigment ink, in cooperation with the effect of the protective layer, the ink jet image which is very superior in long preservability can be obtained. In case that a color ink jet image is formed, ink of three colors of subtractive color mixture of yellow, magenta, and cyan, or ink of more than four colors in which black or other colors are added to these three colors are used.

The protection layer forming portion 2 includes a laminated sheet forming section 21 which supplies, on the ink jet image surface of the recording matter P made by the ink jet recording portion 1, the image protection film F so that the ink jet image surface is opposed to the surface of the transferable protection film $C_F$, and superimposes the recording matter P and the image protection film F thereby to form a laminated sheet PF; a press section which heats and pressurizes the laminated sheet PF and attaches the transferable protective layer $C_F$ onto the ink jet image surface by use of pressure; and a peeling-off section 23 which peels off the supporting body $B_F$ from the laminated sheet PF which has passed through the press section, and rolls the supporting body round to collect it.

The laminated sheet forming section 21 includes a supply roll 211, the image protection film F rolled round the supply roll 211, and an angle adjusting roll 212. The supply roll 211 is a roll about which the rolled image protection film F rotates in film supply. The angle-adjusting roll 212 is arranged slightly movably up-and-down and to the left-and-right in a state where its axis is orthogonal to the transporting direction of the recording matter P. Therefore, the angle adjusting roll 212 can be moved according to necessity and is arranged in an appropriate position, whereby the supply angle of the fed-out image protection film F to the recording matter P can be appropriately adjusted.

The press section 22 includes a pressure roll (pressure member) 221 located above the laminated sheet PF transported from the laminated sheet forming section 21, and a cylindrical pressure reception roll (pressure receiving member) 222 arranged so as to be opposed to the pressure roll 221. The pressure roll 221 and the pressure reception roll 222 are arranged respectively so that their axes come orthogonal to the transporting direction of the laminated sheet PF. The distance between the both rolls can be set arbitrarily, and the both rolls are brought into pressure contact with each other thereby to form a nip portion (firmly inserting portion).

The pressure roll 221 and the pressure reception roll 222, similarly to other rolls constituting the protection layer forming portion 2, are respectively right circular in section, and the length in the axial direction of each of the rolls 221 and 222 is larger than the width of the laminated sheet PF, so that the whole of the laminated sheet PF passing through the nip portion between the both rolls can be heated and pressurized uniformly. Further, though the diameter of the pressure roller 221 and the diameter of the pressure reception roller 222 are the same, they are not always the same but can be changed appropriately.

Figure 2:
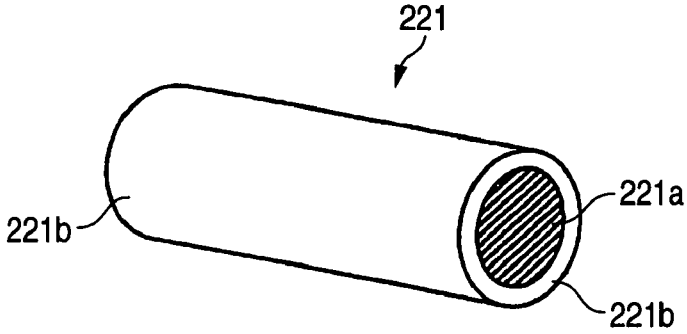
FIG. 2 is a perspective view of a pressure roll in a protection layer forming portion shown in FIG. 1.

The pressure roll 221, as shown in FIG.2, comprises a roll body 221*a* and an elastic layer 221*b* coating the surface of the roll body 221*a*. The roll body 221*a* is constituted so that a heating source such as a heater is arranged inside a hollow-cylindrical aluminum material (so-called heat roll). When the laminated sheet PF is pressurized, the transferable protective layer CF is heated through the elastic layer 221*b* and the supporting body BF, and melted so as to have adhesion. The forming material of the roll body 221 is not limited to aluminum but carbon steels or stainless can be used.

The elastic layer 221 is formed of an elastic matter, and the hardness of this elastic matter is HA 40° or more by a measuring method specified by JIS-K6253 (or ASTM-D2240), and preferably 70° or more. In case that the hardness of the elastic matter is less than HA 40°, the nip width under the pressure is made wide. In result, the nip pressure lowers and following performance of the transferable protection layer to the ink jet image surface lowers, so that air bubbles mix in a non-close attachment part. Further, in case that the ink jet image surface is a finely rough surface, the transferable protection layer does not follow the finely rough surface. Therefore, the protective layer surface of the recording matter with the protective layer lastly obtained becomes flat and high in glossy level, so that the semi-glossy sense which the recording matter naturally has before forming of the protective layer is lost. On the other hand, in case that the hardness of the elastic matter is too hard, the close attachment of the transferable protection layer onto the ink jet image surface becomes insufficient thereby to cause mixing of the air bubbles. In case that the ink jet image surface is the finely rough surface, there is fear that the finely rough surface flattens. Therefore, the least upper bound of the hardness is preferably 90° or less by the above measuring method.

As the above elastic matter, silicon rubber, natural rubber, synthetic natural rubber, styrene rubber, butadiene rubber, chloroprene rubber, butyl rubber, nitril rubber, ethylene-propyrene rubber, and fluororubber are preferably used. Since the silicon rubber of them is particularly superior in parting properties of the roll surface, workability, and cost, it is preferably used in the invention.

Further, the elastic layer 221*b* may have single-layer structure composed of one kind of elastic matter or multi-layer structure in which plural kinds of elastic matters are laminated.

The thickness of the elastic layer 221*b* is preferably 0.2 to 3 mm, and more preferably 0.5 to 2 mm. In case that the elastic layer 221*b* has the multi-layer structure, the whole thickness of the multi-layer structure is set in this range. In case that the thickness is less than 0.2 mm, there is fear of mixing of air bubbles due to shortage of elasticity, or there is fear that in case that the ink jet image surface is a finely rough surface, flattening of the finely rough surface is caused. Further, in case that the thickness is over 3 mm, there is fear that mixing of air bubbles and bad transfer of the transferable protection layer are caused.

The pressure reception roll 222 comprises a metal roll and an elastic layer which coats the surface of the metal roll. As the metal roll, carbon steel material is used much. However, the material is not particularly limited. Further, as the elastic layer, the same as the material of the above elastic layer 221*b* can be used. Further, as the pressure reception roll 222, a single matter having no the elastic layer and comprising only the metal roll can be also used. In this case, the surface of the metal roll can be coated with fluorocarbon resin to provide a parting treatment, or ceramic or chrome can be thermal-sprayed on the surface of the metal roll.

The peeling-off section 23 includes an angle adjusting roll 231 which adjusts a peeling-off angle of the supporting body $B_F$, and a winding roll 232 round which the peeled-off supporting body $B_F$ is wound. The angle adjusting roll 231 is, similarly to the angle adjusting roll 212, arranged slightly movably up-and-down and to the left-and-right, whereby the peeling-off angle can be appropriately adjusted.

Next, the image protection film F which is one of components of the protection layer forming portion 2 will be described in detail. The image protection film F includes, as described above, the supporting body $B_F$, and the transferable protection layer $C_F$ which is provided on the supporting body $B_F$ and attached to the ink jet image surface by use of pressure in the press section 22.

As the supporting body $B_F$, what has such heat-resistance, mechanical strength and thermoplasticity that a shape can be stably kept under the predetermined heating and pressurizing condition in thermal transfer, and has good peeling-off properties from the transferable protection layer $C_F$ attached to the ink jet image surface by use of pressure is preferably used. As such the supporting matter, for example, there are films made of biaxial drawing polypropylene (OPP), polyethylene terephthalate (PET), 1, 4-polycyclohexylenedimethylene terephthalate, polyethylene naphthalate (PEN), polyphenylene sulfide (PPS), polyethersulphone (PES), polystyrene, polypropylene, aramid, polycarbonate, polyvinyl alcohol, cellophane, cellulose derivatives such as cellulose acetate, polyethylene, polyvinyl chloride, nylon, polyimide, ionomer; a metal foil such as aluminum foil; an aluminum evaporation film; paper such as capacitor paper or paraffin paper; a nonwoven fabric; and a composite film of paper or a nonwoven fabric and a resin film As the supporting body $B_F$, an OPP film having preferably 4 to 50 μm thickness and more preferably 5 to 20 μm thickness is particularly preferable. The OPP film is good in heat-resistance, mechanical strength, and transferability, and has a characteristic that this film develops plasticity more readily by heat than a film made of another material such as a PET film. Using the image protection film using the OPP film having such the characteristic, the heat-pressure treatment is performed on the recording matter by the pressure roll 221, whereby the following properties and close attachment of the transferable protection film onto the ink jet image surface can be heightened more, and mixing of air bubbles and flattening of the finely rough surface can be prevented more surely.

The supporting body $B_F$, according to necessity, can include ceramic fine particles, or can be coated on its surface with polyester resin, ester polyacrylate resin, polyvinyl acetate resin, polyurethane resin, stylene acrylate resin, polyacrylate resin, polyacrylamide resin, polyamide resin, polyether resin, polystyrene resin, polyethylene resin, polypropylene resin, polyolefin resin, vinyl resin such as polyvinyl chloride resin, or polyvinyl alocohol resin; cellulose resin such as hydroxyethylcellulose resin, or cellulose acetate resin; polyvinylacetal resin such as polyvinylacetoacetal resin or polyvinyl butyral resin; or heat resistant resin such as modified silicon resin or modified long chain alkyl resin, whereby the heat-resistance can be heightened more. Further, in case that various surface treatment such as parting treatment using silicon, charge preventing treatment, corona discharge treatment, and embossing treatment are performed on the surface of the supporting body $B_F$ on which the transferable protection layer $C_F$ is formed, it is also possible to improve transfer-readiness, prevention of dust attachment due to static electricity, design of the surface of the transferable protection layer.

The transferable protection layer $C_F$ is thermal-transferred onto the ink jet image surface of the recording matter thereby to become a protection layer, and composed of resin. As the resin, resin which can form a coating film that is superior in close attachment to the recording matter, high in transparency, difficult to fade by heat and light, and superior in chemical and physical barrier properties is preferable. As the preferable forming material of the transferable protection layer $C_F$, there are, for example, acrylic copolymer, acrylstyrene copolymer, vinyl acetate resin, vinyl acetate copolymer, vinyl chloride-vinyl acetate copolymer, vinyl chloride-acrylic copolymer, vinyl acetate-acrylic copolymer, and acrylic-silicon copolymer. They can be used in single or in mixture of two or more materials.

Further, the transferable protection layer $C_F$ may adopt single layer structure comprising one kind of resin layer or multi layer structure in which plural kinds of resin layers are laminated.

It is preferable that the thickness of the transferable protective layer $C_F$ is as thin as possible from viewpoints of improvement of close attachment properties to the ink jet image surface, prevention of lowering of the natural sense and quality level of the recording matter, and prevention of deterioration of image quality. However, in case that the thickness is too thine lowering of the protection layer function is caused. Therefore, the thickness of the transferable protective layer $C_F$ is preferably 2 to 20 μm, and more preferably 4 to 10 μm. In case that the transferable protective layer $C_F$ has the multi-layer structure, the whole thickness of the multi-layer structure is set in this range. Further, in case that the transferable protective layer $C_F$ is transferred onto the ink jet image surface and becomes the protective layer, its thickness changes hardly and the thickness of the protective layer is almost in the above range.

The transferable protective layer $C_F$ can include, in addition to the resin component, according to necessity, one kind of additive or two or more kinds of additives such as dye, pigment, release agent, lubricant, anti-foaming agent., dispersant, antistatic agent, ultraviolet absorber, antioxidant, fluorescent dye, and fluorescent whitening dye.

The image protection film F can be manufactured as follows: one kind, or two or more kinds of the above resin, and the above each additive (according to necessity) are added to an appropriate solvent such as water thereby to make a coating liquid; the coating liquid is applied onto the supporting $B_F$ and dried; and thereafter the transferable protective layer $C_F$ is formed on the supporting body $B_F$. Though the transferable protective layer $C_F$ is usually formed on the entire surface of the supporting body $B_F$, it may be formed on a part of the supporting body $B_F$ Coating of the coating liquid can be performed using various painting devices such as a blade coater, a die coater, a reverse roll coater, a gravure roll coater, an air knife coater, a bar coater, a rod blade coater, a curtain coater, a short dowel coater, a size press, a spray.

The operation of each part when the thus constructed image recording apparatus 10 operates will be described referring to FIG. 1.

Upon reception of image data transmitted from a host computer (not shown), the image recording apparatus 10 feeds out the roll-shaped recording sheet M and transports it to the ink jet recording portion 1, and ink of each color is ejected by the recording head 11 thereby to form an ink jet image. The recording sheet M having the ink jet image on its recorded surface becomes a recording matter P, and is transported to the protection layer forming portion 2.

In the protection layer forming portion 2, firstly, an image protection film F is supplied on the ink jet image surface of the recording matter P in the laminated sheet forming section 21 so that the ink jet image surface is opposed to the surface of the transferable protective layer $C_F$, and the image protection film F and the recording matter P are superimposed on each other so as to put the ink jet image surface between thereby to form a laminated sheet PF. Next, in the press section 22, the laminated sheet PF is permitted to pass through the nip portion formed between the pressure roll 221 and the pressure reception member 222 which are brought into pressure contact with each other while it is being heated from the image protection film F side at the predetermined nip pressure. The heating temperature and the nip pressure (line pressure) at this time are appropriately adjusted, in consideration of the forming material and the thickness of the used image protection film F, so that the transferable protective layer $C_F$ can be closely attached onto the ink jet image surface by use of pressure. For example, in case that an OPP film having 4 to 50 μm thickness is used as the supporting body $B_F$, and an acryl copolymer layer having 2 to 20 μm thickness is used as the transferable protective layer $C_F$, the heating temperature (surface temperature of the elastic layer 221*b*) is preferably about 90 to 110° C., and the nip pressure is preferably about 1 to 10 kN/m. The transferable protective layer CE of the laminated sheet PF heated and pressurized in the press section 22 is melted and closely attached onto the ink jet image surface. When the temperature of the transferable protective layer $C_F$ lowers and the transferable protective layer $C_F$ has been attached onto the ink jet image surface by use of pressure, the supporting body $B_F$ is peeled off in the peeling-off section 23, whereby a recording matter P' with a protection layer can be obtained.

The long sheet-shaped recording matter P' with the protective layer is cut into sheets of the desired length by the automatic cutter 3, and stocked as cut-sheets on the sheet discharge tray 4.

In the above mode for carrying out the invention, the protection layer is formed on the long recording sheet (so-called roll sheet). However, it can be similarly formed also on a cut sheet-like recording sheet such as a sheet of A4 size.

According to the invention, the protection layer can be formed, without any problems, also on a recording matter which has an ink jet image surface having high flatness and is superior in glossy level. Particularly, the invention is effective for a recording matter having an ink jet image surface which has fine unevenness and is low in flatness, and specifically for a recording matter in which an ink jet image is formed on a finely rough surface (recorded surface) on which a large number of convex portions having 5 to 20 μm height are formed at 50 to 500 μm pitch. The recording matter having such the finely rough surface is obtained by forming an inkjet image on a finely rough surface of the recording sheet having the finely rough surface as usual.

It is preferable that the recording sheet having the above finely rough surface is manufactured by forming an ink absorption layer as usual on a worked surface of base paper which is worked so that 75 degrees specular glossiness specified by JIS-P8142 becomes less than 30%, and preferably in a range of 10% to 28%. The thus manufactured recording sheet has a unique sense of semi-glossiness due to working of the finely rough surface (the surface of ink absorption layer), and is suitable to output of a photo-like recording matter that is like a silver halide photograph.

Regarding the worked surface (on which the ink absorption layer is formed) of the above base paper, it is preferable that its center average roughness (SRa) is larger than 0.5 in order to obtain a more photo-like ink jet image. Preferably, the roughness is adjusted in a range of 0.7 to 5.0, and more preferably in a range of 0.8 to 4.5. The center average roughness (SRa) means an SRa value in a 0.8 mm cut-off value measured using a stylus three-dimensional surface roughness tester, and is obtained by the following expression (1).

$$SRa = \frac{1}{Sa}\int_0^{Wx}\int_0^{Wy}|f(X, Y)|dX, dY \qquad \text{(Expression 1)}$$

In the expression 1, Wx represents a length in an X-axis direction of a sample surface region, Wy represents a length in a Y-axis direction of the sample surface region, and Sa represents area of the sample surface region.

Specifically, as the stylus three-dimensional surface roughness tester and a three-dimensional roughness analyzer, an SE-3AK type machine and a SPA-11 type machine by Kosaka Laboratory Ltd. are used, and SRa can be obtained under the condition in which a cut-off value is 0.8 mm, Wx=20 mm, Wy=8 mm, and Sa=160 $mm^2$.

Figure 3A:
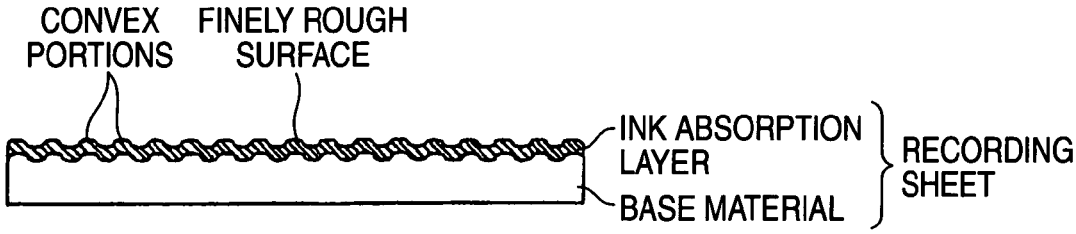
FIG. 3A is a schematically sectional view showing one example of a recording sheet having a finely rough surface.
Figure 3B:
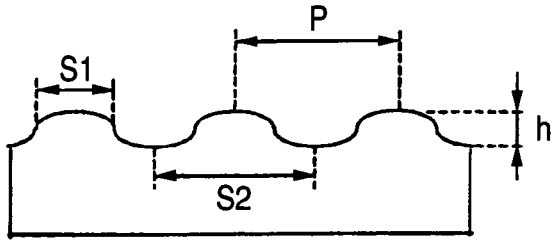
FIG. 3B is a partially enlarged view of the surface of the recording sheet.

One example of the above recording sheet is shown in FIGS. 3A and 3B. A range to which the invention is applied is not limited to the recording sheet shown in FIGS. 3A and 3B. FIG. 3A is a schematically sectional view of the recording sheet, and FIG. 3B is a partially enlarged view of the surface of the recording sheet shown in FIG. 3A. In FIG. 3B, reference character h represents a height (5 to 20 μm) of the convex portion, reference character p is a pitch (distance between the convex portions, 50 to 500 μm), reference character S1 is a sectional area of a top of the convex portion, and reference character S2 is a sectional area of a base of the convex portion. Though S1<S2 in FIGS. 3A and 3B, the size relation between S1 and S2 can be set arbitrarily. Further, the convex portion can be formed in any shape such as a right circle, an ellipse, a square, a rectangle, a rhomb, and a ridgeline shape. The shape of the convex portion is not particularly limited.

As the ink absorption layer constituting the above recording sheet, a porous layer which includes 40 to 90 weight % inorganic particles such as porous amorphous silica, porous magnesium carbonate, and porous aluminum and further includes binder resin such as polyvinyl alcohol is preferable, and its thickness is preferably about 20 to 50 μm.

Further, as the base paper constituting the above recording sheet, there are fine paper, art paper, coated paper, cast coated paper, and resin coated paper. The resin-coated paper (referred to also as a RC paper) has a resin layer on one side or both sides of paper. Particularly, polyolefin coated paper using polyethylene resin as the resin layer is superior in glossiness, quality level, water resistance, and wave after printing, and it is preferably used as the base paper. The polyolefin-coated paper can be manufactured, for example, by extruding the polyolefin resin melted by heat between a paper base and a cooling roll in the shape of a film by an extruding machine and pressing and cooling them. By appropriately adjusting a surface shape of the cooling roll, the surface of the resin layer can be worked into a high glossy surface, a lusterless surface or surfaces patterned with various shapes, for example, a silky surface or a matt surface.

As long as the transfer pressure roll of the invention includes the cylindrical roll body and the elastic layer which coats the surface of the roll body and comes into contact with the image protection film at the pressurizing time, and the hardness of the elastic matter forming the elastic layer is HA 40 degrees or more by the measuring method specified by JIS-K6253, various changes can be made in the invention without departing from the spirit and scope of the invention. For example, in the above mode for carrying out the invention, the pressure roll 221 is the so-called heat roll in which a heating source is arranged but may be a roll having no heating function. However, in this case, it is necessary to arrange a heating source near the pressure roll separately. Further, also in case that the pressure roll has the heating function, according to necessity, the similar heating source can be arranged.

Further, the image recording apparatus and the transfer device (the protection layer forming portion in the image recording apparatus) of the invention are not limited to the above mode for carrying out the invention, but various changes can be made in the shape of each component member, the position of its arrangement, and the number of the arranged members without departing from the spirit and scope of the invention. For example, in the above mode for carrying out the invention, though a pair of the pressure member (pressure roll 221) and the pressure reception member (pressure reception roll 222) are arranged, plural pairs of them can be arranged. Further, in the above mode, though any of the pressure member and the pressure reception member is the cylindrical roll, as long as they are formed in such the shape that the sheet-like matter can be nipped between them, they may be formed in any shape. For example, the pressure member is the cylindrical roll and the pressure reception member may be a flat plate-like matter.

Further, between the press section 22 and the peeling-off section 23 (between the pressure roll 221 and the angle adjusting roll 231), a cooling unit such as a cooling fan or a heat releasing plate can be also set. By thus arranging the cooling unit, the laminated sheet PF which has been heated and pressurized in the press section 22 can be quickly cooled, so that it is possible to expect, in addition to speed-up of a manufacturing line, improvements in close attachment properties of the transferable protection layer onto the ink jet image surface, and in glossy level of the protection layer.

Further, in the image protection film F, in order to improve transferability of the transferable protection layer $C_F$, a 0.5 to 5 μm thick parting layer having colloidal silica as a main component can be also provided between the supporting body $B_F$ and the transferable protection layer $C_F$. Further, on the back surface side (on the side where the transferable protection layer $C_F$ is not formed) of the supporting body $B_F$, a heat-resistant slip layer can be also provided in order to prevent thermal fusion of the heat roll to the heat-press device, improve blocking-resistance, and improve slip properties of the image protection film in paper supply. The heat-resistant slip layer can be formed by applying silicon resin, and its thickness is usually about 0.1 to 10 μm.

EXAMPLES

Though the invention will be described below more concretely with reference to Examples, it is not limited to such the Examples.

Example 1

Acryl emersion (Mowinyl 8030 by Clariant Polymer Co., Ltd.) was uniformly applied on the entire surface on one side of an OPP film (20 μm thick) used as the supporting body by use of a wire bar so that the thickness of the resin becomes 4 μm after dry, and dried. Thereafter, acryl emersion (Mowinyl 790 by Clariant Polymer Co., Ltd.) was uniformly applied onto the entire surface of the coated layer by use of the wire bar so that the thickness of the resin becomes 4 μm after dry, and dried, whereby an image protection film having a transferable protection layer of double-layer structure was manufactured.

Further, an ink jet recording sheet on the market, which has polyolefin coated paper as base paper (Merchandise name "Premium Luster Photo Paper" by Epson America, Inc., 75 degrees specular glossiness of Polyolefin coated paper, which is specified by JIS-P8142: 25%, SRa value: 1.5) was used as the recording sheet having the finely rough surface. On its ink absorption layer, using a pigment ink jet printer (Merchandise name "PM-4000PX" by Seiko Epson Corporation), color patches of cyan, magenta, yellow, and black (ink jet image) were printed thereby to form a recording matter.

The image protection film and the recording matter were superimposed on each other so that the transferable protection layer is opposed to the ink jet image surface thereby to form a laminated sheet. This laminated sheet was permitted to pass through the nip portion formed between the pressure roll and the pressure reception roll which are formed in the shape as shown in FIG. 1, whereby the laminated sheet was heated and pressurized, the transferable protection layer was attached on the ink jet image surface by use of press, and thereafter the OPP film was peeled off from the laminated sheet at a peeling angle of 150° and at a peeling speed (angle formed by the OPP film and the transferable protection layer) of 10 mm/sec. In result, a recording matter with a protective layer was obtained. The press condition of the laminated sheet is as follows (Press condition 1):

(Press Condition 1)

Pressure roll (heat roll): A roll surface of a steel-made core bar was coated with silicon rubber of HA 80° so that the thickness of the silicon rubber becomes 1 mm, Pressure reception roll: A roll surface of a steel-made core bar was coated with silicon rubber of HA 80° so that the thickness of the silicon rubber becomes 1 mm.

Surface temperature of pressure roll: 100° C., Line pressure: 5 kN/m, Passing speed of laminated sheet: 10 mm/sec.

Example 2

Except that the heat-press treatment of the laminated sheet was performed under the following condition (Press condition 2), a recording matter with a protection layer was obtained similarly to in the first Example.

(Press Condition 2)

Pressure roll (heat roll): A roll surface of a steel-made core bar was coated with silicon rubber of HA 50° so that the thickness of the silicon rubber becomes 1 mm.

Pressure reception roll: A roll surface of a steel-made core bar was coated with silicon rubber of HA 50° so that the thickness of the silicon rubber becomes 1 mm.

Surface temperature of pressure roll: 100° C., Line pressure: 5 kN/m, Passing speed of laminated sheet: 10 mm/sec.

Comparative Example 1

Except that the heat-press treatment of the laminated sheet was performed under the following condition (Press condition 3), a recording matter with a protection layer was obtained similarly to in the first Example.

(Press Condition 3)

Pressure roll (heat roll): A roll surface of a steel-made core bar was coated with silicon rubber of HA 30° so that the thickness of the silicon rubber becomes 1 mm.

Pressure reception roll: A roll surface of a steel-made core bar was coated with silicon rubber of HA 30° so that the thickness of the silicon rubber becomes 1 mm.

Surface temperature of pressure roll: 100° C., Line pressure: 5 kN/m, Passing speed of laminated sheet: 10 mm/sec.

[Evaluation of Performance]

Regarding each recording matter with the protective layer thus obtained in the Examples 1 and 2, and the Comparative example 1, the existence of mixing of air bubbles, the change amount of glossy level before and after formation of the protection layer, and close attachment properties of the protective layer were respectively evaluated as follows:

<Mixing of Air Bubbles>

Figure 4:
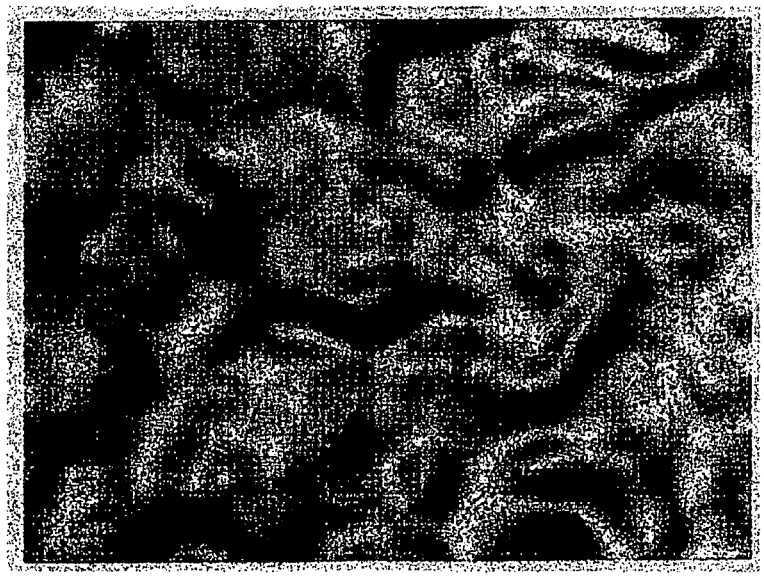
FIG. 4 is a chemical microscope photograph (60 magnifications) of the protection layer surface of a recording matter having a protection layer in Example 1.
Figure 5:
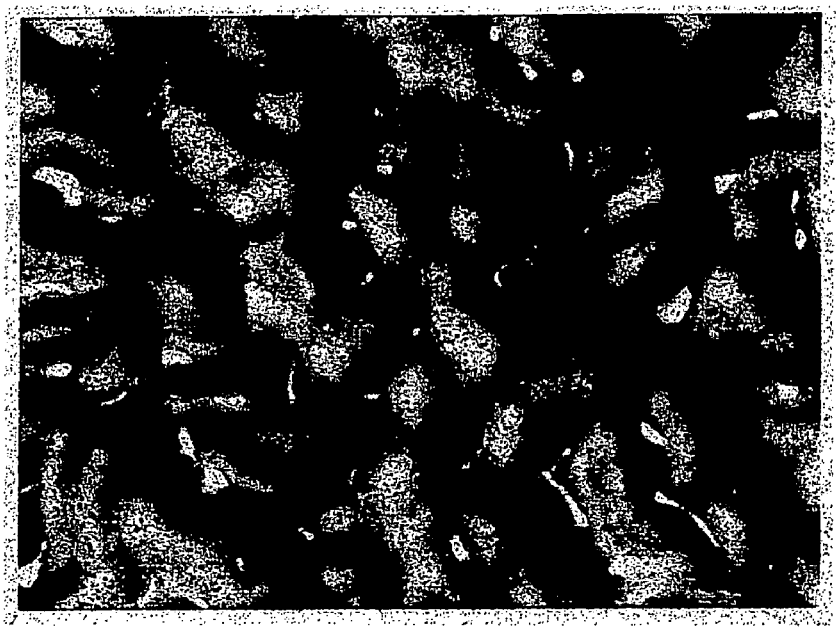
FIG. 5 is a chemical microscope photograph (60 magnifications) of the protection layer surface of a recording matter having a protection layer in Example 2.
Figure 6:
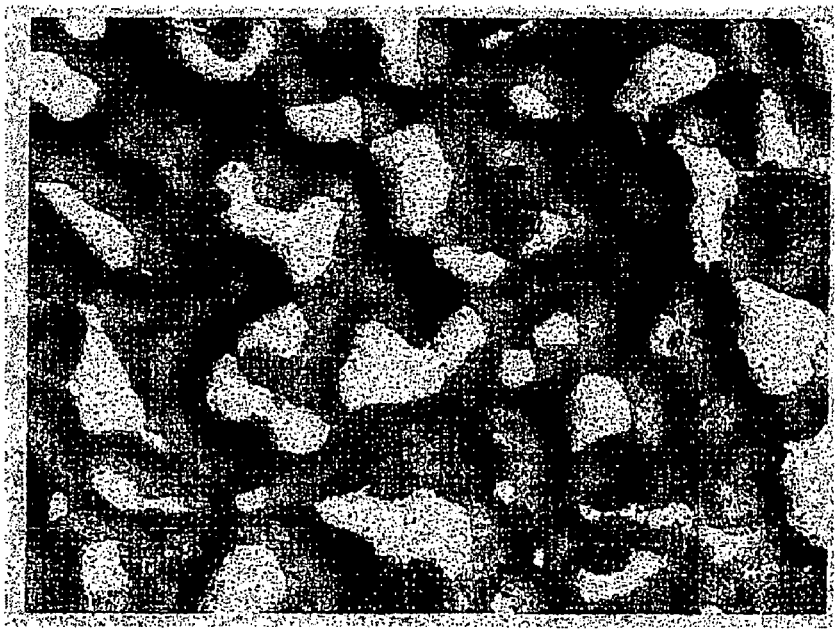
FIG. 6 is a chemical microscope photograph (60 magnifications) of the protection layer surface of a recording matter having a protection layer in Comparative Example 1.
Figure 7:
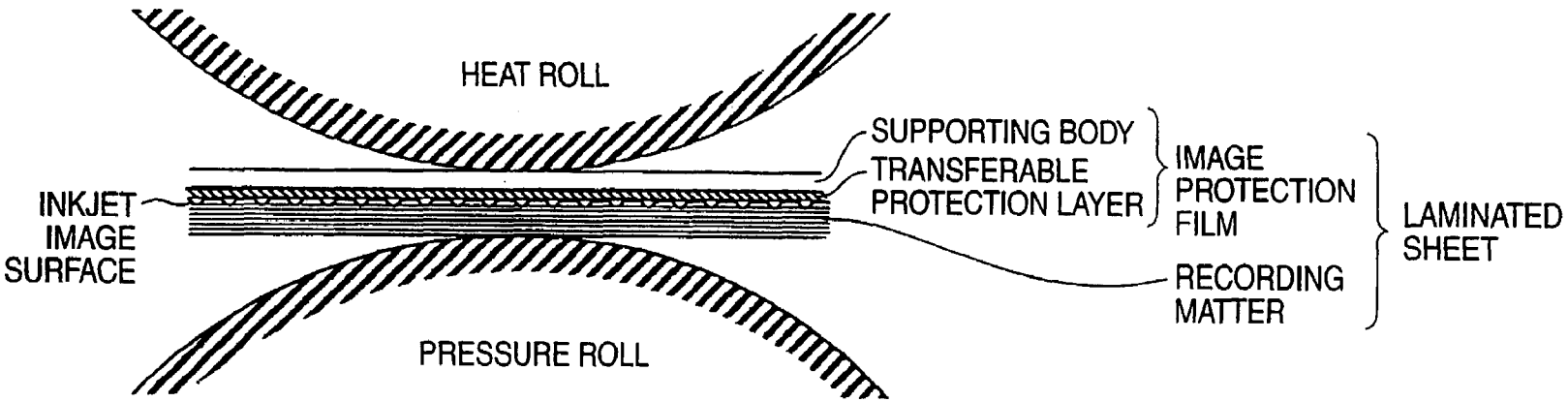
FIG. 7 is a schematic diagram showing a condition of thermal transfer in a conventional transfer device.

Regarding the above each recording matter with the protection layer, a chemical microscope photograph (60 magnifications) of the surface of the protection layer was taken. Compared among Example 1 (refer to FIG. 4), Example 2(refer to FIG. 5), and Comparative Example 1 (refer to FIG. 6), a large number of the air bubbles (white portions in the figure) were found in Comparative Example 1, but the air bubbles were hardly found in Examples 1 and 2, and it was found that the air bubbles mixed hardly between the protection layer and the image surface.

<Change Amount of Glossy Level>

Using a gloss meter "PG-1" by NIPPON DENSHOKU, 60° gloss rate of the surface of the protection layer of the above each recording matter with the protection layer was measured. Further, as a blank, also regarding the printing surface of the above recording matter before forming the protective layer, the 60° gloss rate was measured similarly. In result, in the blank (no protective layer), it was 20%. On the other hand, in Example 1, 30% (10%—increasing rate of gloss rate), in Example 2, 40% (20%—increasing rate of gloss rate), and in Comparative Example 1, 60% (40%—increasing rate of gloss rate). Namely, it is indicated that as the change amount of glossy level (increasing rate of gloss rate) becomes larger, flattening of the finely rough surface of the recording sheet is progressing. In Comparative Example 1, the semi-glossy sense which the recording matter naturally has before forming the protective layer was greatly damaged.

<Close Attachment Properties>

After an adhesive tape was attached on the surface of the protective layer of the above each recording matter with the protective layer, and a 500 g/cm$^3$ load was applied, the adhesive tape was forcibly peeled off. At this time, a case in that the protective layer did not peel off and there was no change was evaluated as A (good close attachment properties), and a case in that the protective layer peeled off and the practical use of the recording matter with the protective layer was difficult was evaluated as B. In result, in Examples 1 and 2, the evaluation was A, and in Comparative Example 1, it was B. It was thought that the reason why Comparative Example 1 was bad in close attachment properties was that a large number of air bubbles mixed between the printing surface and the protective layer as described above.

As the recording sheet having the finely rough surface, in place of the above "Premium Luster Photo Paper", "PM/MC Photo Paper (semi-luster)" (by Seiko Epson Corporation, 75 degrees specular glossiness of polyolefin coated paper, which is specified by JIS-P8142: 12%, SRa value: 2.0) was used, and a recording matter with a protection layer was made similarly. Regarding this recording matter, the existence of mixing of air bubbles, the change amount of glossy level before and after formation of the protection layer, and close attachment properties of the protective layer were respectively evaluated. In result, the similar effects to the aforementioned effects were obtained. Further, also in case that a recording sheet having no finely rough surface such as "PM Photo Paper <luster>" (by Seiko Epson Corporation) was used, a protection layer can be formed without causing any problems by the similar procedure to that in the above Example.

According to the invention, since the transferable protection layer of the image protection film can be closely attached by use of pressure onto the ink jet image formed on the finely rough surface having fine unevenness, without causing mixing of air bubbles and flattening of the finely rough surface, the best use of the natural sense and quality level of the ink jet image is made, and it is possible to provide the recording matter having high image-quality, high glossiness, and good preservability.

What is claimed is:

1. A transferring unit comprising:

(a) feed means for superimposing a transferring film atop a recording material to form a laminated sheet with a transferable protective layer of the transferring film atop a finely roughened surface of the recording material, the finely roughened surface comprising a plurality of raised portions having a height of from 5 to 20 μm and a pitch of from 50 to 500 μm, and the transferable protective layer being provided on a heat-resistant substrate or supporting body;

(b) press-bonding means for heating and pressing the laminated sheet to cause the transferable protective layer to bond to the finely roughened surface of the recording material, said press-bonding means comprising a receiving member and transferring pressure roll means, including a transferring pressure roll, for pressing against the transferring film while the laminated sheet is being heated, said receiving member and transferring pressure roll being disposed adjacent each other with a gap therebetween, said feed means feeding the laminated sheet through the gap between the transferring pressure roll and the receiving member, said transferring pressure roll comprising a cylindrical roll main body and an elastic material layer which covers a surface of the roll main body, said elastic material layer comprising an elastic material with a hardness of HA40 or more as measured by a measuring method defined in JIS-K6253; and (c) peeling means for peeling the heat-resistant substrate off the laminated sheet heated and pressed by the press-bonding means; said feed means feeding the laminated sheet from the press-bonding means to the peeling means.

2. The transferring unit as defined in claim 1, wherein said substrate or supporting body comprises a polypropylene film.

3. The transferring unit as defined in claim 1, wherein a heating source is arranged inside the roll main body.

4. The transferring unit as defined in claim 1, wherein the recording material is formed with a recording sheet including a polyolefine coated sheet having a surface worked so that 75° degrees specular glossiness specified by JIS-P8142 becomes less than 30%, and an ink-absorption layer provided on the worked surface.

5. The transferring unit as defined in claim 4, wherein a center average roughness (SRa) of the worked surface is larger than 0.5.

6. The transferring unit as defined in claim 1, wherein the thickness of the heat-resistant substrate or supporting body is from 4 to 50 μm, and the supporting body is a biaxial drawing polypropylene film.

7. The transferring unit as defined in claim 1, wherein the thickness of the transferable protective layer is from 2 to 20 μm.

8. The transferring unit as defined in claim 1, wherein the transferable protective layer comprises a compound selected from the group consisting of acrylic copolymer, acryl-styrene copolymer, vinyl acetate resin, vinyl acetate copolymer, vinyl chloride-vinyl acetate copolymer, vinyl chioride-acryl copolymer, vinyl acetate-acryl copolymer and acryl-silicone copolymer.

9. The transferring unit as defined in claim 1, wherein the hardness of the elastic material is not so high as to cause a flattening of the finely rough surface.

10. The transferring unit as defined in claim 1, wherein the elastic material has a hardness of HA 90° or less.

11. An ink jet recording apparatus comprising:

(a) the transferring unit of claim 1; and (b) ink jet recording means for ejecting an ink onto the finely roughened recording surface of the recording material, said feed means feeding the recording material past the ink jet recording means prior to alignment of the recording material with the transferring film.

12. The transferring unit as defined in claim 1, wherein the thickness of the elastic material layer is from 0.2 to 3 mm.

13. A recording method comprising the steps of:

(a) providing a recording material having a finely roughened recording surface comprising a plurality of raised portions having a height of from 5 to 20 μm and a pitch of from 50 to 500 μm;

(b) providing a transferring film having a transferable protective layer and a heat-resistant substrate or supporting body;

(c) forming an ink image on the recording surface by ejecting an ink onto the recording surface;

(d) superimposing the transferring film atop the recording material with the transferable protective layer of the transferring film atop the ink image on the recording surface of the recording material;

(e) bonding the transferable protective layer to the recording surface by pressing the transferable protective layer against the recording surface with a transferring pressure roll while heating whereby to form a protective layer on the ink image; the transferring pressure roll comprising a cylindrical roll main body and an elastic material layer which covers a surface of the roll main body and contacts the transferring film during the pressing, the elastic material layer comprising an elastic material having a hardness of HA40 or more as measured by a measuring method defined in JIS-K6253.

14. The recording method as defined in claim 13, further comprising the step of:

(e) peeling the heat resistant substrate from the transferring film.

15. The recording method as defined in claim 13 ,wherein the elastic material is selected from the group consisting of silicone rubber, natural rubber, synthetic natural rubber, styrene rubber, butadiene rubber, chloroprene rubber, butyl rubber, nitrile rubber, ethylene propylene rubber and fluororubber.

16. The recording method as defined in claim 13, wherein the thickness of the elastic material layer is from 0.2 to 3 mm.

17. The recording method as defined in claim 13, wherein a thickness of the heat-resistant substrate is from 4 to 50 μm and the supporting body is a biaxial drawing polypropylene film.

18. The recording method as defined in claim 13, wherein a thickness of the transferable protective layer is from 2 to 20 μm.

19. The recording method as defined in claim 13, wherein the transferable protective layer comprises a compound selected from the group consisting of acrylic copolymer, acryl-styrene copolymer, vinyl acetate resin, vinyl acetate copolymer, vinyl chloride-vinyl acetate copolymer, vinyl chloride-acryl copolymer, vinyl acetate-acryl copolymer and acryl-silicone copolymer.

20. The recording method as defined in claim 13, wherein a surface temperature of the elastic material layer is from about 90° C. to 110° C.

21. The recording method as defined in claim 13, wherein a nip pressure of the elastic material layer is from 1 to 10 kN/m.

* * * * *